US011295644B2

(12) United States Patent
Hong

(10) Patent No.: US 11,295,644 B2
(45) Date of Patent: Apr. 5, 2022

(54) DISPLAY DEVICE AND METHOD FOR MEASURING LUMINANCE PROFILE THEREOF

(71) Applicant: SAMSUNG DISPLAY CO., LTD., Yongin-si (KR)

(72) Inventor: Seok Ha Hong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/104,331

(22) Filed: Nov. 25, 2020

(65) Prior Publication Data

US 2021/0366392 A1 Nov. 25, 2021

(30) Foreign Application Priority Data

May 19, 2020 (KR) ..... 10-2020-0059987

(51) Int. Cl.

*G09G 3/00* (2006.01)
*G09G 3/3233* (2016.01)
*G09G 3/20* (2006.01)

(52) U.S. Cl.

CPC ..... *G09G 3/006* (2013.01); *G09G 3/2007* (2013.01); *G09G 3/3233* (2013.01); *G09G 2320/0233* (2013.01); *G09G 2320/0673* (2013.01); *G09G 2360/145* (2013.01); *G09G 2360/16* (2013.01)

(58) Field of Classification Search

CPC .... G09G 3/006; G09G 3/2007; G09G 3/3233; G09G 2320/0233; G09G 2320/0673; G09G 2360/145; G09G 2360/16

USPC ..... 345/207

See application file for complete search history.

(56) References Cited

U.S. PATENT DOCUMENTS

| | | | | |
|---|---|---|---|---|
| 8,669,997 | B2 * | 3/2014 | Kotani | G09G 3/006 345/589 |
| 8,872,737 | B2 | 10/2014 | Shin et al. | |
| 9,202,412 | B2 | 12/2015 | Odawara et al. | |
| 10,672,344 | B2 | 6/2020 | Kim | |
| 10,964,241 | B2 * | 3/2021 | Kim | G09G 3/006 |
| 11,176,859 | B2 * | 11/2021 | Orio | G09G 3/006 |

(Continued)

FOREIGN PATENT DOCUMENTS

| | | | |
|---|---|---|---|
| KR | 101276529 | B1 | 6/2013 |
| KR | 101400605 | B1 | 5/2014 |

(Continued)

*Primary Examiner* — Jason M Mandeville
(74) *Attorney, Agent, or Firm* — Cantor Colburn LLP

(57) ABSTRACT

A method for measuring a luminance profile of a display device including pixels divided into blocks, includes: measuring a first reference luminance profile when a partial area of each of the blocks is in a display state and a remaining area of each of the blocks is in a non-display state; measuring a first luminance profile when an entire area of a first block among the blocks is in the display state, the partial area of each of remaining blocks is in the display state, and the remaining area of each of the remaining blocks is in the non-display state; and measuring a second luminance profile when an entire area of a second block among the blocks is in the display state, the partial area of each of remaining blocks is in the display state, and the remaining area of each of the remaining blocks is in the non-display state.

7 Claims, 9 Drawing Sheets

(56) References Cited

U.S. PATENT DOCUMENTS

| | | | | |
|---|---|---|---|---|
| 2011/0148904 | A1* | 6/2011 | Kotani | H04N 9/3179<br>345/589 |
| 2020/0211429 | A1* | 7/2020 | Kim | G09G 3/006 |

FOREIGN PATENT DOCUMENTS

| | | | |
|---|---|---|---|
| KR | 101509118 | B1 | 4/2015 |
| KR | 1020170079998 | A | 7/2017 |

* cited by examiner

DISPLAY DEVICE AND METHOD FOR MEASURING LUMINANCE PROFILE THEREOF

The application claims priority to Korean Patent Application No. 10-2020-0059987, filed May 19, 2020, and all the benefits accruing therefrom under 35 U.S.C. § 119, the content of which in its entirety is herein incorporated by reference.

BACKGROUND

Field

Embodiments according to the present invention relate to a display device and a method for measuring a luminance profile thereof.

Discussion

With the development of information technology, the importance of a display device, which is a connection medium between users and information, has been emphasized. In response to this, the use of the display device such as a liquid crystal display device, an organic light emitting display device, a plasma display device, and the like has been increasing.

The display device may include a plurality of pixels, and the pixels may use at least one common power source voltage. The voltage drop amounts (IR drop amounts) of the power source voltage in the pixels may be different depending on positions of the pixels and grayscale values. In order to solve a mura display issue and the like, data voltages in which the voltage drop amounts are properly compensated must be supplied to the pixels.

There is a method of calculating internal resistances of the display device in advance and calculating the voltage drop amounts using the same. However, since the calculated voltage drop amounts are different from the luminance drop amounts when actually displayed, the mura display issue may be difficult to resolve effectively.

SUMMARY

A technical problem to be solved is to provide a display device and a method for measuring a luminance profile thereof capable of effectively solving a mura display issue by reflecting luminance drop amounts when actually displayed.

As a method for measuring a luminance profile of a display device including pixels divided into a plurality of blocks, the method for measuring the luminance profile according to an embodiment of the present invention includes: measuring a first reference luminance profile when a partial area of each of the blocks is in a display state and a remaining area of each of the blocks is in a non-display state; measuring a first luminance profile when an entire area of a first block among the blocks is in the display state, the partial area of each of first remaining blocks is in the display state, and the first remaining area of each of the remaining blocks is in the non-display state, where the first remaining blocks are the plurality of blocks except for the first block; and measuring a second luminance profile when an entire area of a second block among the blocks is in the display state, the partial area of each of second remaining blocks is in the display state, and the remaining area of each of the second remaining blocks is in the non-display state, where the first remaining blocks are the plurality of blocks except for the first block.

The remaining area may be larger than the partial area.

In the measuring of the first reference luminance profile, the partial area of each of the blocks may display white. In the measuring of the first luminance profile, the entire area of the first block may display white, and the partial area of each of the first remaining blocks may display white. In the measuring of the second luminance profile, the entire area of the second block may display white, and the partial area of each of the second remaining blocks may display white.

In the measuring of the first reference luminance profile, the partial area of each of the blocks may display a first color. In the measuring of the first luminance profile, the partial area of the first block may display the first color, the remaining area of the first block may display white, and the partial area of each of the first remaining blocks may display the first color. In the measuring of the second luminance profile, the partial area of the second block may display the first color, the remaining area of the second block may display white, and the partial area of each of the second remaining blocks may display the first color.

The method for measuring the luminance profile may further include: measuring a second reference luminance profile when the partial area of each of the blocks displays a second color and the remaining area of each of the blocks is in the non-display state; measuring a third luminance profile when the partial area of the first block displays the second color, the remaining area of the first block displays white, the partial area of each of the first remaining blocks displays the second color, and the remaining area of each of the first remaining blocks is in the non-display state; and measuring a fourth luminance profile when the partial area of the second block displays the second color, the remaining area of the second block displays white, the partial area of each of the second remaining blocks displays the second color, and the remaining area of each of the second remaining blocks is in the non-display state.

In the measuring of the first reference luminance profile, the measuring of the first luminance profile, and the measuring of the second luminance profile, the partial area may display the first color by emission of pixels of the first color and non-emission of pixels of remaining colors except for the first color among pixels included in the partial area. In the measuring the second reference luminance profile, the measuring of the third luminance profile, and the measuring of the fourth luminance profile, the partial area may display the second color by emission of pixels of the second color and non-emission of pixels of remaining colors except for the second color among the pixels included in the partial area.

The method for measuring the luminance profile may further include: storing a difference between the first reference luminance profile and the first luminance profile as a first block luminance profile; and storing a difference between the first reference luminance profile and the second luminance profile as a second block luminance profile.

A display device according to an embodiment of the present invention includes: pixels divided into a plurality of blocks; and a grayscale converter which converts input grayscales for the pixels into output grayscales. Each of the blocks may include at least two of the pixels, and the grayscale converter may generate the output grayscales based on block currents calculated from the input grayscales and prestored block luminance profiles.

The grayscale converter may include a luminance drop amount calculator which scales each of the block luminance profiles in correspondence with a size of each of the block currents.

The luminance drop amount calculator may scale the block luminance profiles and scale the block luminance profile to be smaller as the block current corresponding to the block luminance profile is smaller.

The luminance drop amount calculator may generate an overall luminance profile by summing scaled block luminance profiles.

The luminance drop amount calculator may interpolate the overall luminance profile to calculate luminance drop amounts of the pixels.

The grayscale converter may further include a luminance domain converter converting the input grayscales into input luminances of a luminance domain.

The luminance domain converter may apply a gamma curve to the input grayscales to convert the input grayscales into the input luminances.

The grayscale converter may further include a compensation value calculator which calculates compensation values based on the input luminances and the luminance drop amounts.

The compensation value calculator may calculate the compensation values according to a ratio of each of the luminance drop amounts to each of the input luminances.

The compensation value calculator may calculate a larger compensation value as the ratio of the luminance drop amount to the input luminance increases.

The grayscale converter may further include an output grayscale calculator which sums the input grayscales and the compensation values to calculate the output grayscales.

The each of the block currents may be a sum value of driving currents expected to flow in light emitting diodes of the pixels included in each of the blocks.

The light emitting diodes may be commonly connected between a first power line and a second power line.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
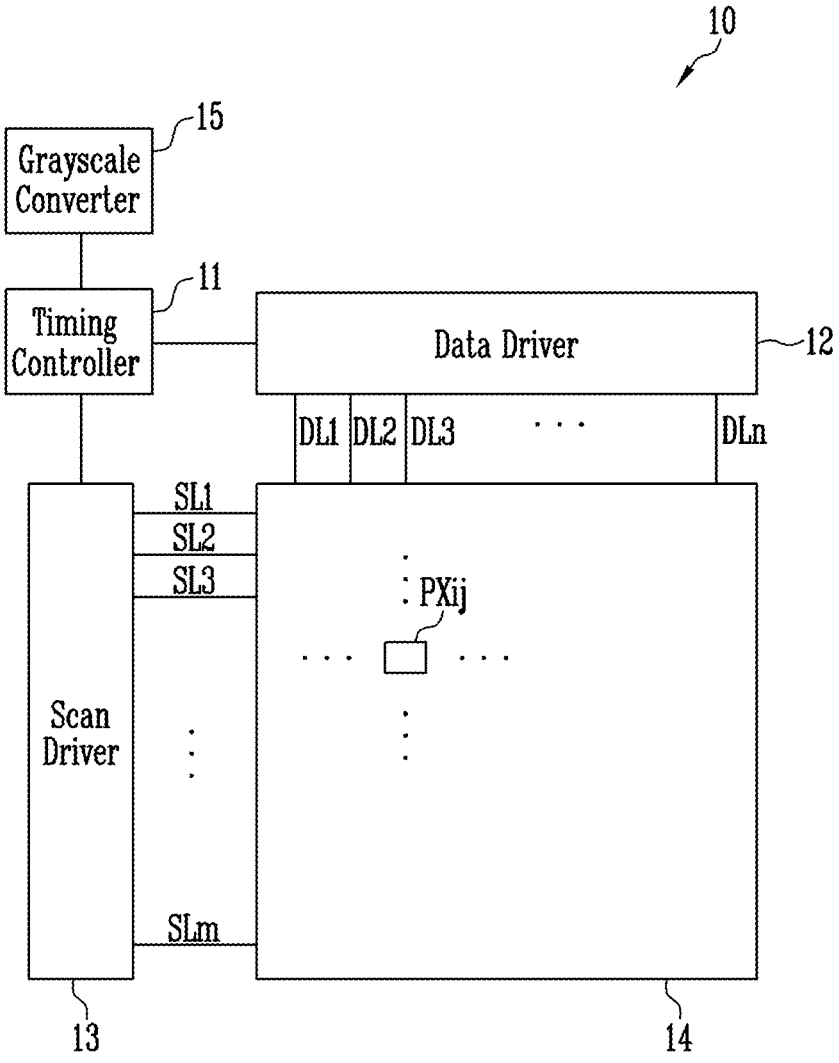
FIG. 1 is a block diagram for explaining a display device according to an embodiment of the present invention.

Hereinafter, embodiments of the present invention will be described in detail with reference to the accompanying drawings so that those skilled in the art can easily implement the present invention. The present invention may be embodied in various different forms and is not limited to the embodiments described herein.

In order to clearly describe the present invention, parts that are not related to the description are omitted, and the same or similar components are denoted by the same reference numerals throughout the specification. Therefore, the above-mentioned reference numerals can be used in other drawings. It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein. The terminology used herein is for the purpose of describing particular embodiments only and is not intended to be limiting. As used herein, the singular forms "a," "an," and "the" are intended to include the plural forms, including "at least one," unless the content clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

In addition, the size and thickness of each component shown in the drawings are arbitrarily shown for convenience of description, and thus the present invention is not necessarily limited to those shown in the drawings. In the drawings, thicknesses may be exaggerated to clearly express the layers and regions.

FIG. 1 is a block diagram for explaining a display device according to an embodiment of the present invention.

Referring to FIG. 1, a display device 10 according to an embodiment of the present invention may include a timing controller 11, a data driver 12, a scan driver 13, a pixel unit 14 (in other words, "display panel"), and a grayscale converter 15.

The timing controller 11 may receive input grayscales and control signals for each frame (i.e., input image) from an external processor. The timing controller 11 may provide control signals suitable for each specification to the data driver 12, the scan driver 13, and the like to display the frame.

Figure 4:
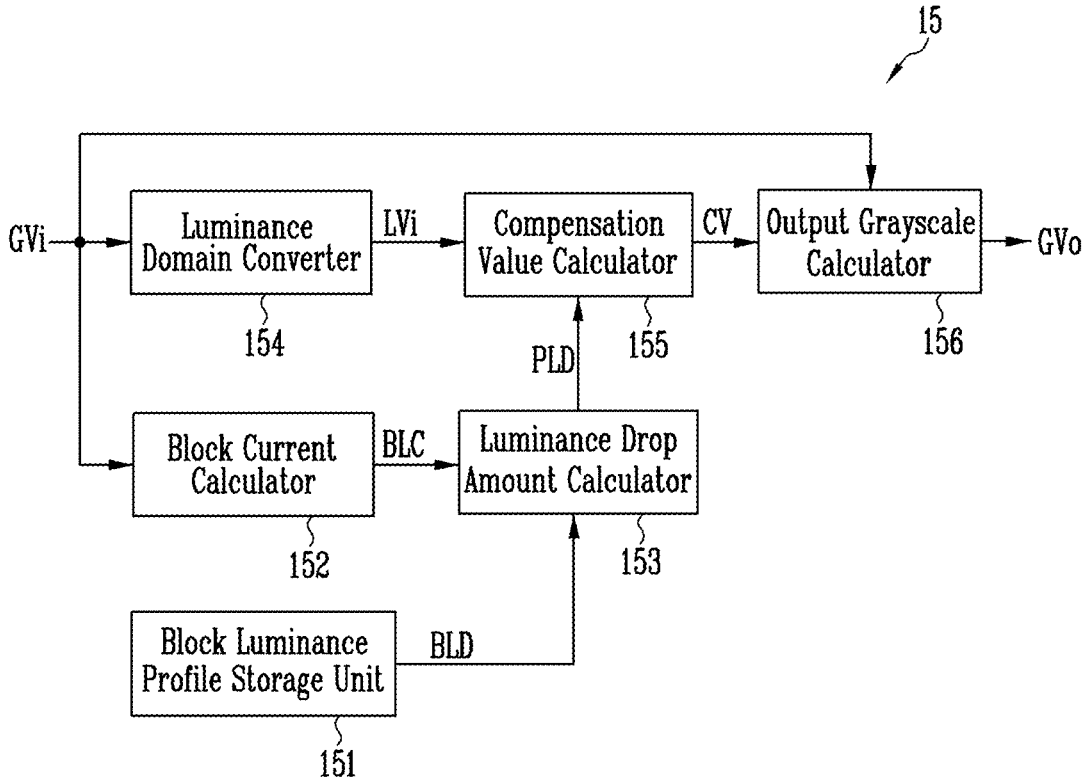
FIG. 4 is a block diagram for explaining a grayscale converter according to an embodiment of the present invention.

The grayscale converter 15 may provide output grayscales GVo obtained by converting the input grayscales GVi (See FIG. 4). The timing controller 11 may provide the output grayscales GVo to the data driver 12. The grayscale converter 15 may be composed of an integrated circuit ("IC") chip integrated with the timing controller 11 or the data driver 12, or may be composed of a separate IC from the timing controller 11 and the data driver 12. In another embodiment, the grayscale converter 15 may be implemented by software in the timing controller 11 or the data driver 12.

The data driver 12 may generate data voltages using the output grayscales Gvo and the control signals and provide the data voltages to data lines DL1, DL2, DL3, and DLn. For example, the data driver 12 may sample the output grayscales GVo using a clock signal and apply the data voltages corresponding to the output grayscales GVo to the data lines DL1 to DLn in units of pixel rows, where n may be an integer greater than 0. A pixel row may mean a group of pixels connected to one scan line.

The scan driver 13 may receive a clock signal, a scan start signal, and the like from the timing controller 11, generate scan signals, and provide the scan signals to scan lines SL1, SL2, SL3, and SLm, where m may be an integer greater than 0.

The scan driver 13 may sequentially supply the scan signals having a turn-on level pulse to the scan lines SL1 to SLm. The scan driver 13 may be configured in the form of a shift register, and may include a plurality of scan stages. The scan driver 13 may generate the scan signals by sequentially transmitting the scan start signal in the form of a turn-on level pulse to the next scan stage under the control of the clock signal.

The pixel unit 14 may include pixels. Each pixel PXij may be connected to a corresponding data line and scan line, where i and j may be integers greater than 0. The pixel PXij may refer to a pixel in which a scan transistor is connected to an i-th scan line SLi and a j-th data line DLj. The pixels may be commonly connected to a first power line ELVDDL and a second power line ELVSSL (refer to FIG. 2).

Figure 2:
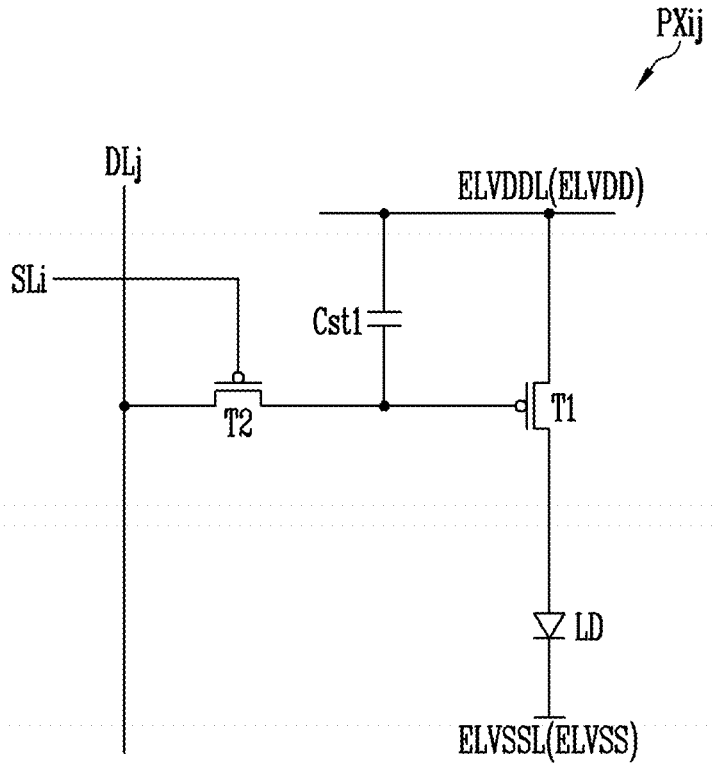
FIG. 2 is a circuit diagram for explaining a pixel according to an embodiment of the present invention.

FIG. 2 is a circuit diagram for explaining a pixel according to an embodiment of the present invention.

Referring to FIG. 2, the pixel PXij may be a pixel that emits light of a first color. Pixels emitting light of a second color or a third color may have substantially the same configurations as the pixel PXij except for a light emitting diode LD, and thus duplicate description for the same configurations will be omitted.

For example, the first color may be one of red, green, and blue colors, the second color may be one of red, green, and blue colors other than the first color, and the third color may be the remaining color other than the first color and the second color among red, green, and blue colors. In addition, as the first to third colors, magenta, cyan, and yellow colors may be used instead of the red, green, and blue colors in another embodiment.

The pixel PXij may include a plurality of transistors T1 and T2, a storage capacitor Cst1, and the light emitting diode LD.

In this embodiment, the transistors are shown as P-type transistors, for example, PMOS transistors. However, a person skilled in the art would be able to construct a pixel circuit having the same function using N-type transistors, for example, NMOS transistors.

The transistor T2 may include a gate electrode connected to a scan line SLi, a first electrode connected to a data line DLj, and a second electrode connected to a gate electrode of the transistor T1. Transistor T2 may be referred to as a scan transistor.

The transistor T1 may include the gate electrode connected to the second electrode of the transistor T2, a first electrode connected to the first power line ELVDDL, and a second electrode connected to an anode of the light emitting diode LD. The transistor T1 may be referred to as a driving transistor.

The storage capacitor Cst1 may connect the first electrode and the gate electrode of the transistor T1.

The light emitting diode LD may include the anode connected to the second electrode of the transistor T1, and a cathode connected to the second power line ELVSSL. The light emitting diode LD may be an element that emits light having a wavelength corresponding to the first color. The light emitting diode LD may be an organic light emitting diode, or an inorganic light emitting diode such as a micro LED (light emitting diode) and a quantum dot light emitting diode. In addition, the light emitting diode LD may be a light emitting element composed of or including an organic material and an inorganic material. In this embodiment, only one light emitting diode LD is shown, but a plurality of sub light emitting diodes may be connected in series, in parallel, or in series and parallel to replace the light emitting diode LD in another embodiment.

When the scan signal of a turn-on level (low level) is supplied to the gate electrode of the transistor T2 through the scan line SLi, the transistor T2 may connect the data line DLj and a first electrode of the storage capacitor Cst1. Therefore, a voltage according to a difference between a data voltage applied through the data line DLj and a first power source voltage ELVDD may be written to the storage capacitor Cst1.

The transistor T1 may cause a driving current determined according to the voltage written to the storage capacitor Cst1 to flow from the first power line ELVDDL to the second power line ELVSSL. The light emitting diode LD may emit light with a luminance according to the amount of the driving current. The light emitting diodes LD of the pixels PX may be commonly connected between the first power line ELVDDL and the second power line ELVSSL.

Figure 3:
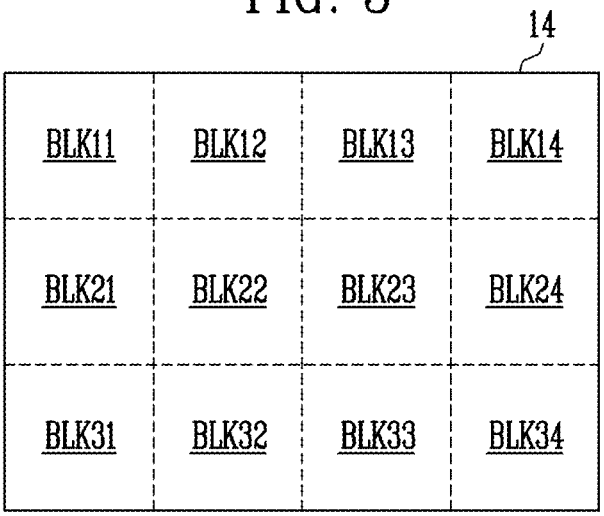
FIG. 3 is a diagram for explaining blocks according to an embodiment of the present invention.

FIG. 3 is a diagram for explaining blocks according to an embodiment of the present invention.

Referring to FIG. 3, the pixels of the pixel unit 14 may be divided into a plurality of blocks BLK11, BLK12, BLK13, BLK14, BLK21, BLK22, BLK23, BLK24, BLK31, BLK32, BLK33, and BLK34. Each of the blocks BLK11 to BLK34 may include at least two pixels.

In an embodiment, for example, when the pixel unit 14 has a resolution of Ultra High Definition ("UHD"), the pixel unit 14 may include 3840*2160 pixels. In this case, 3840 pixels may be arranged in one horizontal line. For example, 3840 pixels may be connected to one scan line. At this time, 2160 pixels may be arranged in one vertical line. For example, 2160 pixels may be connected to one data line.

For example, the pixel unit 14 may be divided into 100 blocks. Each of the blocks may include the same number of pixels. For example, each of the blocks may include 384*216 pixels. However, hereinafter, for convenience of description, the pixel unit 14 divided into 12 blocks BLK11 to BLK34 will be described as an example.

Figure 5:
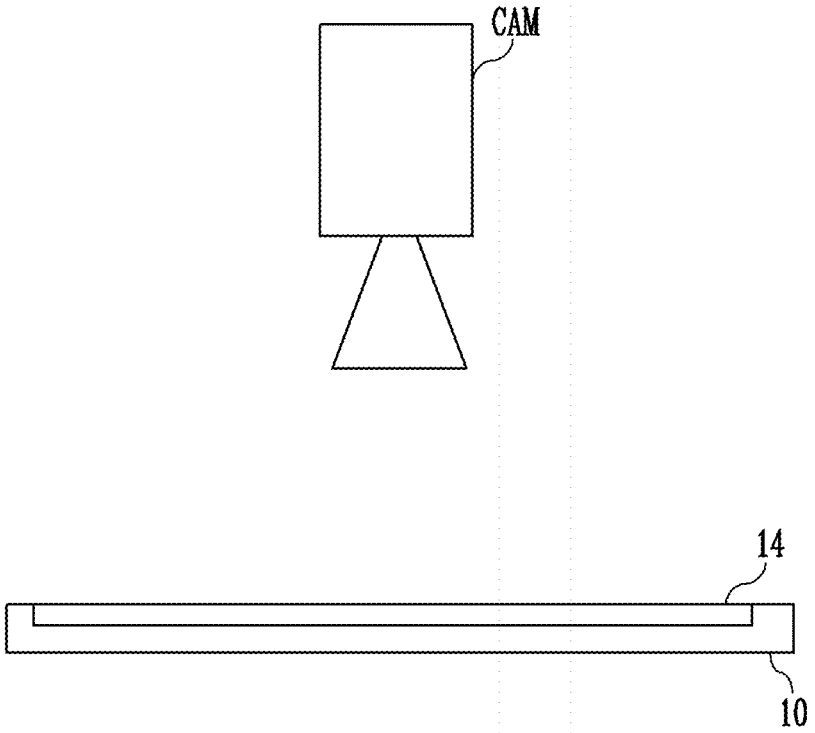
FIGS. 5 and 6 are diagrams for explaining a method for measuring a luminance profile according to an embodiment of the present invention.
Figure 6:
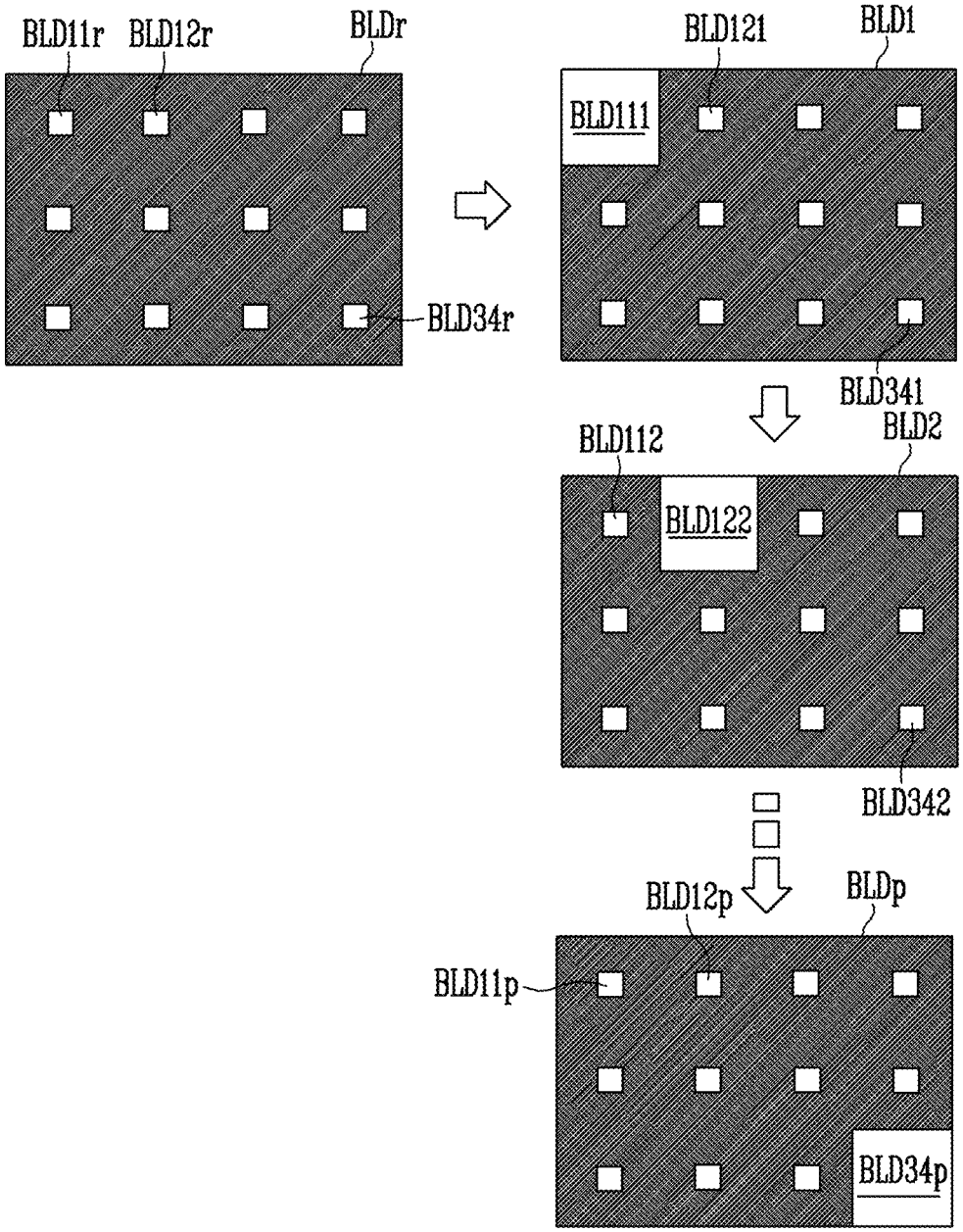
Figure 7:
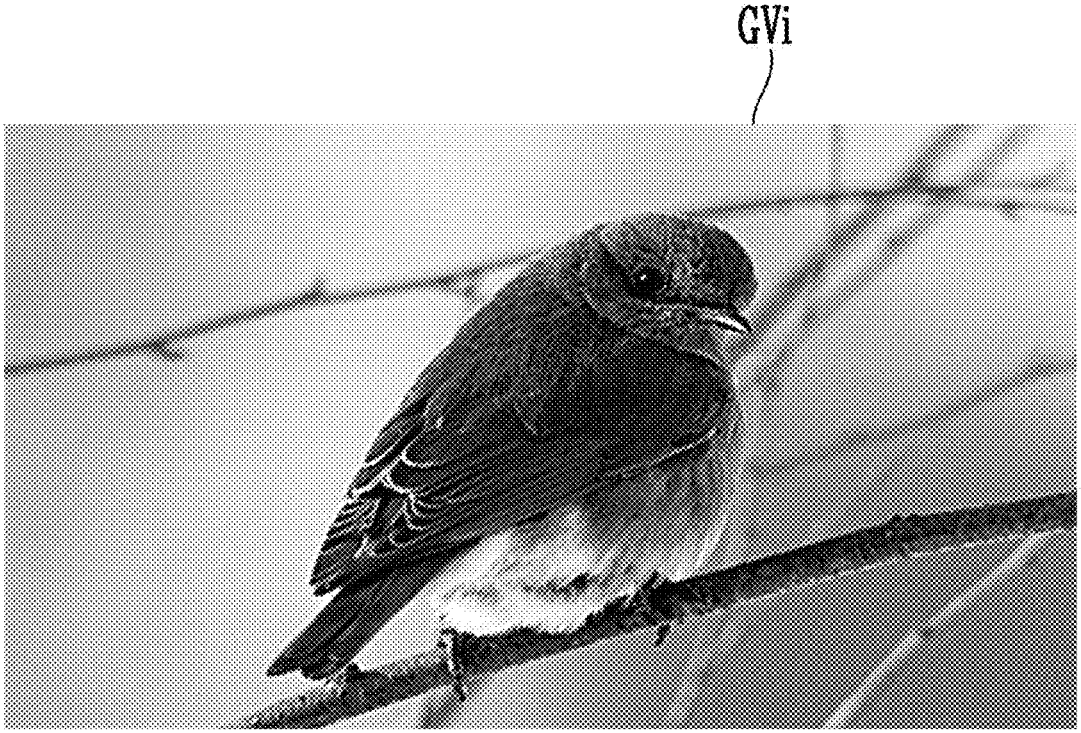
FIGS. 7 and 8 are diagrams for explaining block currents according to an embodiment of the present invention.
Figure 8:
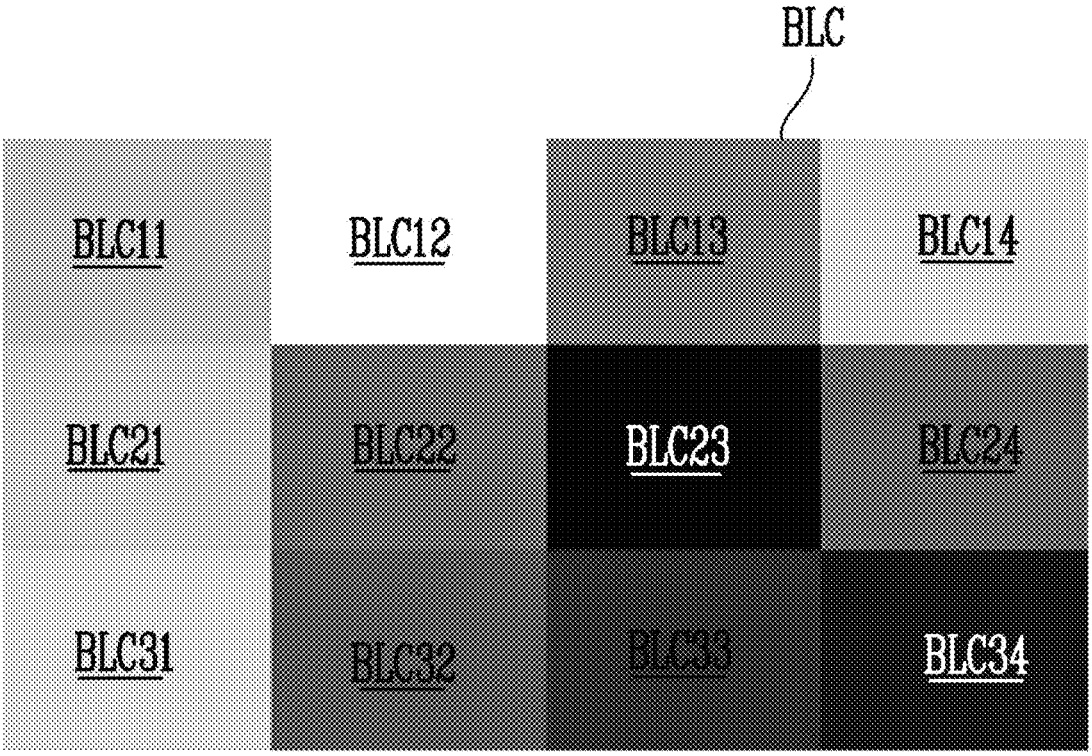
Figure 9:
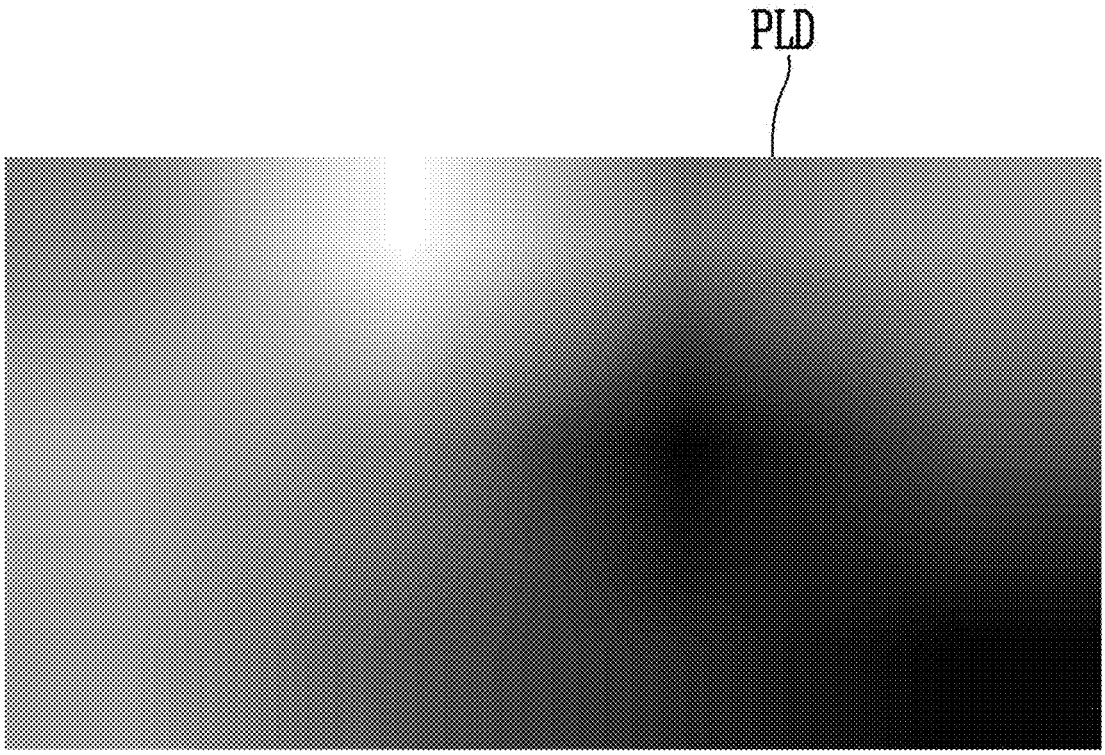
FIG. 9 is a diagram for explaining luminance drop amounts according to an embodiment of the present invention.
Figure 10:
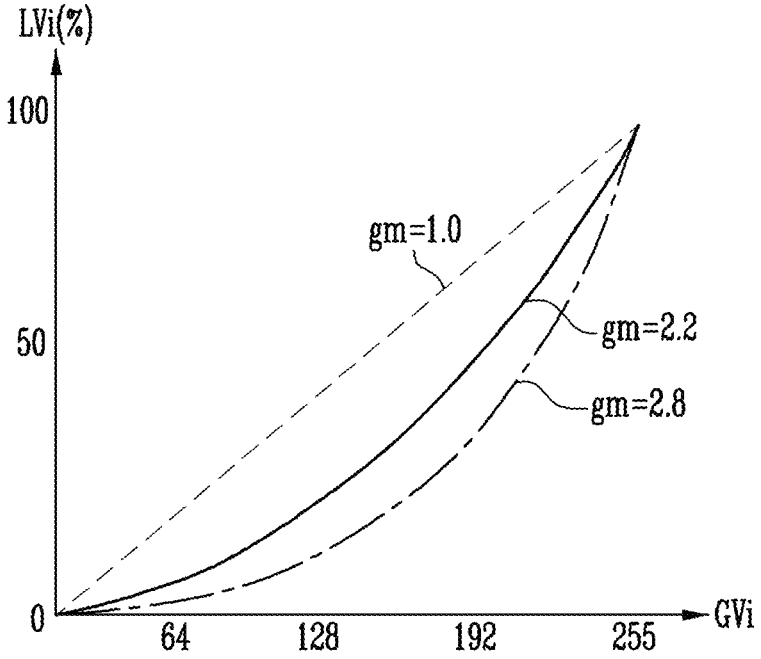
FIG. 10 is a diagram for explaining a luminance domain converter according to an embodiment of the present invention.

FIG. 4 is a block diagram for explaining a grayscale converter 15 according to an embodiment of the present invention. FIGS. 5 and 6 are diagrams for explaining a method for measuring a luminance profile according to an embodiment of the present invention. FIGS. 7 and 8 are diagrams for explaining block currents according to an embodiment of the present invention. FIG. 9 is a diagram for explaining luminance drop amounts according to an embodiment of the present invention. FIG. 10 is a diagram for explaining a luminance domain converter according to an embodiment of the present invention.

Referring to FIG. 4, the grayscale converter 15 according to an embodiment of the present invention may include a block luminance profile storage unit 151, a block current calculator 152, a luminance drop amount calculator 153, a luminance domain converter 154, a compensation value calculator 155, and an output grayscale calculator 156.

The grayscale converter 15 may generate output grayscales GVo based on block currents BLC calculated from input grayscales GVi and stored block luminance profiles BLD.

The block luminance profile storage unit 151 may store the block luminance profiles BLD in advance. The block luminance profile storage unit 151 may be composed as a separate memory from other memories or as a part of another memory.

Referring to FIGS. 5 and 6, a luminance profile measurement of the display device 10 may be performed before the display device 10 is shipped. For example, the display device 10 may display a plurality of patterns, and a camera CAM may capture the patterns displayed on the pixel unit 14 to measure luminance profiles. The block luminance profiles BLD calculated based on the measured luminance profiles may be stored in the block luminance profile storage unit 151. Thereafter, the display device 10 may be shipped. The block luminance profiles BLD based on the luminance profiles may be calculated by an external computing device.

For example, the camera CAM may measure a first reference luminance profile BLDr when partial areas BLD11*r*, BLD12*r*, . . . , and BLD34*r* of the blocks BLK11 to BLK34 are in a display state and the remaining areas of the blocks BLK11 to BLK34 are in a non-display state as shown in the first figure of FIG. 6. In the step of measuring the first reference luminance profile BLDr, the partial areas BLD11*r*, BLD12*r*, . . . , and BLD34*r* of the blocks BLK11 to BLK34 may display white (i.e., the maximum grayscale).

In this case, the partial areas BLD11*r*, BLD12*r*, . . . , and BLD34*r* may be minimum areas for the camera CAM to measure the luminance of each of the blocks. The partial areas BLD11*r*, BLD12*r*, . . . , and BLD34*r* may be referred to as observation areas. Areas of the partial areas BLD11*r*, BLD12*r*, . . . , and BLD34*r* are sufficiently small, so that the voltage drop due to the display state of the partial areas BLD11*r*, BLD12*r*, . . . , and BLD34*r* can be ignored.

The remaining areas may refer to areas in which the partial areas BLD11*r*, BLD12*r*, . . . , and BLD34*r* are excluded from an entire area of each of the blocks. The camera CAM may not measure the luminance of the remaining areas. The remaining areas may be referred to as non-observation areas. The remaining areas may be larger than the partial areas BLD11*r*, BLD12*r*, . . . , and BLD34*r*. That is, the number of the pixels included in the remaining areas may be more than the number of the pixels included in the partial areas BLD11*r*, BLD12*r*, . . . , and BLD34*r*. Areas of the remaining areas are sufficiently large, so that the voltage drop may occur when the remaining areas are in the display state. Voltage drop amounts may increase as the remaining areas emit light with high luminance or emit light close to white grayscale.

When measuring the first reference luminance profile BLDr, since the remaining areas of all the blocks BLK11 to BLK34 are in the non-display state, the first reference luminance profile BLDr may include reference luminances of the blocks BLK11 to BLK34 in which no voltage drops occur. In this case, the reference luminances are luminances of the partial areas BLD11*r*, BLD12*r*, . . . , and BLD34*r* of the blocks BLK11 to BLK34.

When an entire area BLD111 of a first block BLK11 among the blocks BLK11 to BLK34 is in the display state, the partial areas BLD121 to BLD341 of the remaining blocks BLK12 to BLK34 are in the display state, and the remaining areas of the remaining blocks BLK12 to BLK34 are in the non-display state. The camera CAM may measure a first luminance profile BLD1 in this state. In the step of measuring the first luminance profile BLD1, the entire area BLD111 of the first block BLK11 may display white, and the partial areas BLD121 to BLD341 of the remaining blocks BLK12 to BLK34 may display white.

Since the entire area BLD111 of the first block BLK11 displays white, a maximum voltage drop due to the first block BLK11 may occur. Accordingly, in the first luminance profile BLD1, a voltage drop generated by the first block BLK11 (or the remaining area of the first block BLK11) may be reflected in the luminances of the partial areas BLD121 to BLD341 of the other blocks BLK12 to BLK34. In addition, in the first luminance profile BLD1, the voltage drop generated by the first block BLK11 (or the remaining area of the first block BLK11) may be reflected in the luminance of the partial area of the first block BLK11.

When an entire area BLD122 of the second block BLK12 among the blocks BLK11 to BLK34 is in the display state, the partial areas BLD112 . . . and BLD342 of the remaining blocks BLK11 and BLK13 to BLK34 are also in the display state, and the remaining areas of the remaining blocks BLK11 and BLK13 to BLK34 are in the non-display state. The camera CM may measure a second luminance profile BLD2 in this state. In the step of measuring the second luminance profile BLD2, the entire area BLD122 of the second block BLK12 may display white, and the partial areas BLD112, . . . , and BLD342 of the remaining blocks BLK11 and BLK13 to BLK34 may display white.

Since the entire area BLD122 of the second block BLK12 displays white, the maximum voltage drop due to the second block BLK12 may occur. Accordingly, in the second luminance profile BLD2, a voltage drop generated by the second block BLK12 (or the remaining area of the second block BLK12) may be reflected in the luminances of the partial areas BLD112, . . . , and BLD342 of the other blocks BLK11 and BLK13 to BLK34. In addition, in the second luminance profile BLD2, the voltage drop generated by the second block BLK12 (or the remaining area of the second block BLK12) may be reflected in the luminance of the partial area of the second block BLK12.

The camera CM may repeat this process as many times as the number of blocks BLK11 to BLK34 to measure luminance profiles BLD1 to BLDp. For example, when an entire area (e.g., DBL34*p*) of a p-th block (for example, the block BLK34) among the blocks BLK11 to BLK34 is in the display state, the partial areas BLD11*p*, BLD12*p* . . . of the remaining blocks BLK11 to BLK33 are in the display state, and the remaining areas of the remaining blocks BLK11 to BLK33 are in the non-display state. The camera CM may measure a p-th luminance profile BLDp in this state. In this case, p may be an integer greater than 1 and be equal to the total number of the blocks.

Next, the external computing device may calculate a difference between the first reference luminance profile BLDr and the first luminance profile BLD1 as a first block luminance profile, and store the calculated first block luminance profile in the block luminance profile storage unit 151. The first block luminance profile may include luminance drop amounts generated in the blocks when the first block BLK11 emits light at a maximum grayscale.

Similarly, the external computing device may calculate a difference between the first reference luminance profile BLDr and the second luminance profile BLD2 as a second block luminance profile, and store the calculated second block luminance profile in the block luminance profile storage unit 151. The second block luminance profile may include luminance drop amounts generated in the blocks when the second block BLK12 emits light at the maximum grayscale. The external computing device may repeat this process as many times as the number of blocks BLK11 to BLK34 to store p block luminance profiles in the block luminance profile storage unit 151.

The block current calculator 152 may calculate block currents BLC11 to BLC34 based on the input grayscales GVi (refer to FIGS. 7 and 8). Each of the block currents BLC11 to BLC34 may be a sum value of driving currents expected to flow in the light emitting diodes of the pixels included in each of the blocks BLK11 to BLK34. For example, the block current BLC11 may be the sum value of the driving currents expected to flow in the light emitting diodes of the pixels included in the block BLK11.

Referring to FIG. 7, an exemplary input image composed of the input grayscales GVi is shown. It is expected that relatively large driving currents will flow to the light emitting diodes in the bright portion of the input image, and relatively small driving currents will flow to the light emitting diodes in the dark portion of the input image. Referring to FIGS. 7 and 8, the block current BLC12 of the block BLK12 corresponding to the bright portion of the input image in FIG. 7 is expected to be large, and the block current BLC23 of the block BLK23 corresponding to the dark portion of the input image in FIG. 7 is expected to be small.

In an embodiment, the block current calculator 152 may calculate expected block currents BLC11 to BLC34 by summing the input grayscales GVi corresponding to each of the blocks BLK11 to BLK34 or by calculating an average of the input grayscales GVi corresponding to each of the blocks BLK11 to BLK34. For example, the block current calculator 152 may calculate the block current BLC11 by summing the input grayscales GVi of the pixels included in the block BLK11 or by calculating the average of the input grayscales GVi of the pixels included in the block BLK11.

In another embodiment, the block current calculator 152 may multiply the input grayscales GVi corresponding to each of the blocks BLK11 to BLK34 by weights to convert the input grayscales GVi into a current domain, and sum or average the input grayscales GVi of the current domain to calculate the expected block currents BLC11 to BLC34. For example, the block current calculator 152 may multiply the input grayscales GVi of the pixels included in the block BLK11 by the weights to convert the input grayscales GVi into the current domain, and sum or average the input grayscales GVi of the current domain to calculate the block current BLC11.

In another embodiment, the block current calculator 152 may convert the input grayscales GVi corresponding to each of the blocks BLK11 to BLK34 into the current domain by referring to a lookup table, and sum or average the input grayscales GVi of the current domain to calculate the expected block currents BLC11 to BLC34. For example, the block current calculator 152 may convert the input grayscales GVi of the pixels included in the block BLK11 into the current domain by referring to the lookup table, and sum or average the input grayscales GVi of the current domain to calculate the block current BLC11.

The luminance drop amount calculator 153 may scale each of the block luminance profiles BLD in correspondence to the size of each of the block currents BLC. The luminance drop amount calculator 153 may scale a block luminance profile of the block luminance profiles BLD to be smaller as the block luminance profile of the block currents BLC is smaller. Scaling can be performed by multiplying a scale factor corresponding to each of the block luminance profiles BLD.

Since the block luminance profiles BLD stored in the block luminance profile storage unit 151 correspond to a case where the maximum voltage drop occurs in each of the blocks, the scale factor may have a range of 0 to 1. For example, the largest scale factor may be applied to the block luminance profile of the block BLK12 having the largest block current BLC12. When the block BLK12 displays white grayscale, the scale factor of 1 may be applied. For example, the smallest scale factor may be applied to the block luminance profile of the block BLK23 having the smallest block current BLC23. When the block BLK23 displays black grayscale, the scale factor of 0 may be applied.

The luminance drop amount calculator 153 may generate an overall luminance profile by summing the scaled block luminance profiles. Accordingly, the voltage drop amounts generated in all blocks BLK11 to BLK34 may be reflected in the luminance drop amount of each of the blocks in the overall luminance profile.

The luminance drop amount calculator 153 may interpolate the overall luminance profile to calculate the luminance drop amounts PLD of the pixels. For example, by bilinear interpolation between the luminance drop amounts of adjacent blocks, the luminance drop amounts PLD of the pixels may be calculated. The interpolation may be linear interpolation as well as nonlinear interpolation.

The luminance domain converter 154 may convert the input grayscales GVi into input luminances LVi of a luminance domain. For example, the luminance domain converter 154 may apply a gamma curve to the input grayscales GVi to convert the input grayscales GVi into the input luminances LVi. Referring to FIG. 10, gamma curves when gamma values gm are 1.0, 2.2, and 2.8 are shown as examples.

The compensation value calculator 155 may calculate compensation values CV based on the input luminances LVi and the luminance drop amounts PLD. For example, the compensation value calculator 155 may calculate the compensation values CV according to a ratio of each of the luminance drop amounts PLD to each of the input luminances LVi. For example, the compensation value calculator 155 may calculate a larger compensation value for a pixel as the ratio of the luminance drop amount PLD to the input luminance LVi in the pixel increases. For example, when the input luminance of the pixel PXij is 100 Nits and the luminance drop amount is 5 Nits, the ratio of the luminance drop amount to the input luminance for the pixel PXij may be 5 percentages (%). In this case, since relatively large compensation is required, the compensation value calculator 155 may generate a compensation value of (+)7 grayscales. For example, when the input luminance of the pixel PXij is 500 Nits and the luminance drop amount is 5 Nits, the ratio of the luminance drop amount to the input luminance for the pixel PXij may be 1%. In this case, since relatively small compensation is required, the compensation value calculator 155 may generate the compensation value of (+)1 grayscale.

According to an embodiment, the compensation value calculator 155 may apply an inverted gamma curve in generating the compensation values CV. For example, in generating the compensation values CV, the compensation value calculator 155 may apply the inverted gamma curve based on the gamma value gm of the luminance domain converter 154.

The output grayscale calculator 156 may calculate the output grayscales GVo by summing the input grayscales GVi and the compensation values CV.

Accordingly, according to this embodiment, the compensation values CV are not calculated based on internal resistances calculated in the display device 10 and voltage drop amounts according to Ohm's law, but may be calculated based on the luminance drop amounts actually measured in the display device 10. Thus, the mura display issue can be effectively solved.

Figure 11:
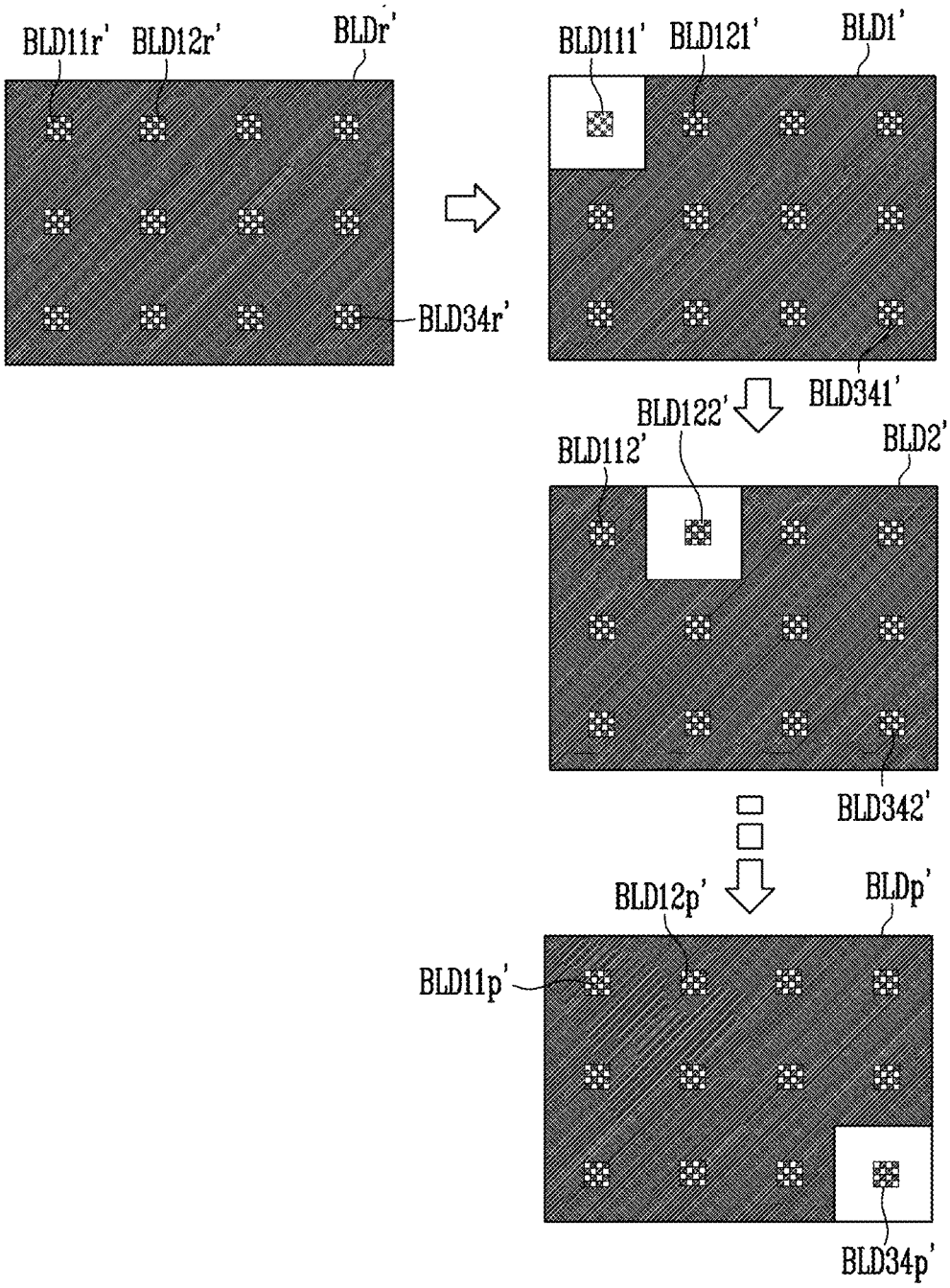
FIG. 11 is a diagram for explaining a method for measuring a luminance profile according to another embodiment of the present invention.

FIG. 11 is a diagram for explaining a method for measuring a luminance profile according to another embodiment of the present invention.

Referring to FIG. 11, unlike in the case of FIG. 6, the partial areas of the blocks BLK11 to BLK34 display colors other than white.

For example, in a step of measuring a first reference luminance profile BLDr', partial areas BLD11*r*' and BLD12*r*' to BLD34*r*' of the blocks BLK11 to BLK34 may display the first color (for example, red).

In a step of measuring a first luminance profile BLD1', the partial area BLD111' of the first block BLK11 may display the first color, the remaining area of the first block BLK11 may display white, and the partial areas BLD121' to BLD341' of the remaining blocks BLK12 to BLK34 may display the first color.

In a step of measuring a second luminance profile BLD2', the partial area BLD122' of the second block BLK12 may display the first color, the remaining area of the second block BLK12 may display white, and the partial areas BLD112', . . . , and BLD342' of the remaining blocks BLK11 and BLK13 to BLK34 may display the first color. In this manner, p luminance profiles for the first color may be measured. For example, in a step of measuring a p-th luminance profile BLD*p*', the partial areas BLD11*p*', BLD12*p*' . . . , and BLD34*p*' of the blocks BLK11 to BLK34 may display the first color. In this case, p may be an integer greater than 1 and be equal to the total number of the blocks.

In an embodiment, for example, in the step of measuring the first reference luminance profile BLDr', the step of measuring the first luminance profile BLD1', and the step of measuring the second luminance profile BLD2', only pixels of the first color among the pixels included in the partial areas emit light and pixels of the remaining colors does not emit light, so that the partial areas may display the first color.

According to this embodiment, the block luminance profiles based on the first reference luminance profile BLDr', the first luminance profile BLD1', and the second luminance profile BLD2' may be used to accurately calculate the luminance drop amounts PLD of the display device 10 when displaying the first color.

As described with reference to FIG. 2, the pixels of the pixel unit 14 may correspond to any one of the first color, the second color (for example, green), and the third color (for example, blue). Therefore, block luminance profiles for the second color and the third color may be additionally required.

For example, the method for measuring the luminance profile may further include a step of measuring a second reference luminance profile when the partial area of each of the blocks BLK11 to BLK34 displays the second color and the remaining area of each of the blocks BLK11 to BLK34 is in the non-display state.

In addition, the method for measuring the luminance profile may further include a step of measuring a third luminance profile when the partial area of the first block BLK11 displays the second color, the remaining area of the first block BLK11 displays white, the partial areas of the remaining blocks BLK12 to BLK34 display the second color, and the remaining areas of the remaining blocks BLK12 to BLK34 are in the non-display state.

In addition, the method for measuring the luminance profile may further include a step of measuring a fourth luminance profile when the partial area of the second block BLK12 displays the second color, the remaining area of the second block BLK12 displays white, the partial areas of the remaining blocks BLK11 and BLK13 to BLK34 display the second color, and the remaining areas of the remaining blocks BLK11 and BLK13 to BLK34 are in the non-display state. Here, the "third" luminance profile and the "fourth" luminance profile for the second color are named with the mere purpose of distinguishing from the first luminance profile BLD1' and the second luminance profile BLD2' for the first color. In this manner, p luminance profiles for the second color may be measured. In this case, p may be an integer greater than 1 and be equal to the total number of the blocks.

For example, in the step of measuring the second reference luminance profile, the step of measuring the third luminance profile, and the step of measuring the fourth luminance profile, only pixels of the second color among the pixels included in the partial areas emit light and the pixels of the remaining colors do not emit light, so that the partial areas may display the second color.

The block luminance profiles for the third color may also be calculated in a similar manner as described above, and thus duplicate description will be omitted.

In another embodiment, in generating the block luminance profiles, the partial areas of the blocks BLK11 to BLK34 may display gray rather than white. Assuming an ideal case where a luminance contribution ratio of red, green, and blue is 1:1:1, white may be composed of red of 255 grayscales, green of 255 grayscales, and blue of 255 grayscales. Gray may be composed of red of q grayscale, green of q grayscale, and blue of q grayscale. For example, q may be an integer greater than 0 and less than 255. Black may be composed of red of 0 grayscale, green of 0 grayscale, and blue of 0 grayscale.

According to this embodiment, the luminance drop amounts PLD for the intermediate grayscale as well as the white corresponding to the highest grayscale can be accurately calculated.

The display device and the method for measuring the luminance profile according to the present invention can effectively solve the mura display issue by reflecting the luminance drop amounts when actually displayed.

The drawings referred to heretofore and the detailed description of the invention described above are merely illustrative of the invention. It is to be understood that the invention has been disclosed for illustrative purposes only and is not intended to limit the scope of the invention. Therefore, those skilled in the art will appreciate that various modifications and equivalent embodiments are possible without departing from the scope of the invention. Accordingly, the true scope of the invention should be determined by the technical idea of the appended claims.

What is claimed is:

1. A method for measuring a luminance profile of a display device including pixels divided into a plurality of blocks, comprising:

measuring a first reference luminance profile when a partial area of each of the blocks is in a display state and a remaining area of each of the blocks is in a non-display state;

measuring a first luminance profile when an entire area of a first block among the blocks is in the display state, the partial area of each of first remaining blocks is in the display state, and the remaining area of each of the first remaining blocks is in the non-display state, wherein the first remaining blocks are the plurality of blocks except for the first block; and measuring a second luminance profile when an entire area of a second block among the blocks is in the display state, the partial area of each of second remaining blocks is in the display state, and the remaining area of each of the second remaining blocks is in the non-display state, wherein the second remaining blocks are the plurality of blocks except for the second block.

2. The method of claim 1, wherein the remaining area is larger than the partial area.

3. The method of claim 1, wherein in the measuring of the first reference luminance profile, the partial area of each of the blocks displays white, wherein in the measuring of the first luminance profile, the entire area of the first block displays white and the partial area of each of the first remaining blocks displays white, and wherein in the measuring of the second luminance profile, the entire area of the second block displays white and the partial area of each of the second remaining blocks displays white.

4. The method of claim 1, wherein in the measuring of the first reference luminance profile, the partial area of each of the blocks displays a first color, wherein in the measuring of the first luminance profile, the partial area of the first block displays the first color, the remaining area of the first block displays white, and the partial area of each of the first remaining blocks displays the first color, and wherein in the measuring of the second luminance profile, the partial area of the second block displays the first color, the remaining area of the second block displays white, and the partial area of each of the second remaining blocks displays the first color.

5. The method of claim 4, further comprising:

measuring a second reference luminance profile when the partial area of each of the blocks displays a second color and the remaining area of each of the blocks is in the non-display state;

measuring a third luminance profile when the partial area of the first block displays the second color, the remaining area of the first block displays white, the partial area of each of the first remaining blocks displays the second color, and the remaining area of each of the first remaining blocks is in the non-display state; and measuring a fourth luminance profile when the partial area of the second block displays the second color, the remaining area of the second block displays white, the partial area of each of the second remaining blocks displays the second color, and the remaining area of each of the second remaining blocks is in the non-display state.

6. The method of claim 5, wherein in the measuring of the first reference luminance profile, the measuring of the first luminance profile, and the measuring of the second luminance profile, the partial area displays the first color by emission of pixels of the first color and non-emission of pixels of remaining colors except for the first color among pixels included in the partial area, and wherein in the measuring of the second reference luminance profile, the measuring of the third luminance profile, and the measuring of the fourth luminance profile, the partial area displays the second color by emission of pixels of the second color and non-emission of pixels of remaining colors except for the second color among the pixels included in the partial area.

7. The method of claim 1, further comprising:

storing a difference between the first reference luminance profile and the first luminance profile as a first block luminance profile; and storing a difference between the first reference luminance profile and the second luminance profile as a second block luminance profile.

* * * * *